US007354331B2

(12) United States Patent
Sala

(10) Patent No.: US 7,354,331 B2
(45) Date of Patent: Apr. 8, 2008

(54) INTERACTIVE EATING UTENSILS AND CONTAINERS THAT CAN PRODUCE SOUND AND MECHANICAL OUTPUT

(75) Inventor: Andre Sala, Albany, CA (US)

(73) Assignee: Star H.K. Electronic Limited, Kowloon (HK)

( * ) Notice: Subject to any disclaimer, the term of this patent is extended or adjusted under 35 U.S.C. 154(b) by 618 days.

(21) Appl. No.: 10/414,369

(22) Filed: Apr. 15, 2003

(65) Prior Publication Data

US 2003/0233753 A1 Dec. 25, 2003

(30) Foreign Application Priority Data

Apr. 15, 2002 (HK) ..... 02102823

(51) Int. Cl.
*A63H 30/00* (2006.01)

(52) U.S. Cl. ..... 446/175; 446/130; 446/304

(58) Field of Classification Search ..... 446/129–130, 446/136, 175, 227, 304, 135; 30/142
See application file for complete search history.

(56) References Cited

U.S. PATENT DOCUMENTS 5,189,793 A 3/1993 Ratzon et al.
5,823,329 A * 10/1998 Roberts ..... 206/216
6,352,258 B1 * 3/2002 Fitzgerald et al. ..... 273/138.1
6,386,937 B1 * 5/2002 Cappello et al. ..... 446/139

FOREIGN PATENT DOCUMENTS

| | | |
|---|---|---|
| AU | CS/02/0063 | 5/2002 |
| FR | 2794551 | 12/2000 |
| JP | 08-080242 | 3/1996 |
| JP | 09-168465 | 3/1997 |

* cited by examiner

*Primary Examiner*—Robert E Pezzuto
*Assistant Examiner*—Alex F. R. P. Rada, II
(74) *Attorney, Agent, or Firm*—William J. Sapone; Coleman Sudol Sapone P.C.

(57) ABSTRACT

A set of interactive eating utensils includes a first eating utensil, such as a spoon or other piece of cutlery, and a container for containing food. The spoon or other cutlery piece has an embedded magnet that produces a magnetic field. The container is electrically operable and includes an induction coil that is electrically operatively connected to a speaker for producing sound upon the interaction of the magnetic field of the magnet and an electromagnetic field of the induction coil generated upon passing of an electric current through the coil. The container has a moveable portion that moves in response to a predetermined set of conditions, such as failure of the induction coil magnetic field to interact with first eating utensil magnetic field for a predetermined period of time.

10 Claims, 7 Drawing Sheets

INTERACTIVE EATING UTENSILS AND CONTAINERS THAT CAN PRODUCE SOUND AND MECHANICAL OUTPUT

PRIORITY

This application claims priority to Hong Kong patent application no. 02102823.7, filed Apr. 15, 2002, which is specifically incorporated by reference as if reproduced in full below, and a copy of which is appended hereto and a made a part hereof.

FIELD OF THE INVENTION

This inventions relates to feeding and entertainment devices for children, and more particularly relates to interactive food serving containers and eating utensils that both entertain and encourage consumption of food provided in a container by producing an output responsive to movement of an eating utensil, such as cutlery, with respect to the container that interacts with the container.

BACKGROUND OF THE INVENTION

Parents and child caregivers frequently note that the capacity of children, especially toddlers, to concentrate on a given task is very limited. One often finds it very difficult to feed a toddler, and even more difficult to teach a toddler to feed himself or herself. Parents have therefore tried many ways to try to urge a toddler to finish a meal, e.g. some by promising sweets or candies after the meal, and some by scolding or threat of punishment, neither of which being very satisfactory.

An interactive set of eating utensils comprising an eating utensil and food container is disclosed in Japanese patent publication number 08-080242. The container makes a sound when the eating utensil moves in close proximity to the container. While this device provides audible and stationary visual encouragement, it does not provide further animated visual or mechanical stimulation to help maintain the interest of the user.

It is thus an object of the present invention to provide a set of interactive eating utensils and containers that encourage a toddler to feed himself or herself, and to derive joy and interest in doing so, or at least to provide a useful alternative to the trade and public.

BRIEF SUMMARY OF THE INVENTION

In a preferred embodiment, the present invention comprises at least one eating utensil, such as a fork, spoon or other cutlery, and at least one container adapted to contain food and interact electromagnetically with an eating utensil of the present invention. An eating utensil of the present invention includes at least one magnetic member that produces a magnetic field, and a container of the present invention includes at least one induction coil that produces a magnetic field upon an electric current passing through it. At least one of the aforementioned induction coils is electrically connected to at least a first output producing device, wherein the first output producing device produces a first output upon the interaction of the magnetic field of the magnetic member in an eating utensil with an electromagnetic field of said induction coil generated upon passing of an electric current therethrough. Preferably, a second output producing device is activated to produce a second output when the magnetic field produced by an eating utensil of the present invention does not interact with the electromagnetic field produced by an activated induction coil in a container of the present invention for a predetermined period of time. At least one eating utensil of the present invention combined with at least one container of the present invention may be referred to as a set of eating utensils. Preferably, one of said first and second outputs is at least one sound while the other output is at least one readily visible mechanical motion of a portion of the container.

An embodiment of a set of eating utensils according to the present invention will now be described, by way of an example only, and with reference to the accompanying drawings.

DETAILED DESCRIPTION OF A PREFERRED EMBODIMENT

An embodiment of a container of a set of eating utensils according to the present invention is shown in FIGS. 1 to 4, and generally designated as 100. The container 100 is in the general shape of a cow, although shapes of other animals, e.g. hippopotamus or cats, may be employed. In particular, the container 100 has a head portion 102 and a body portion 104.

Figure 1:
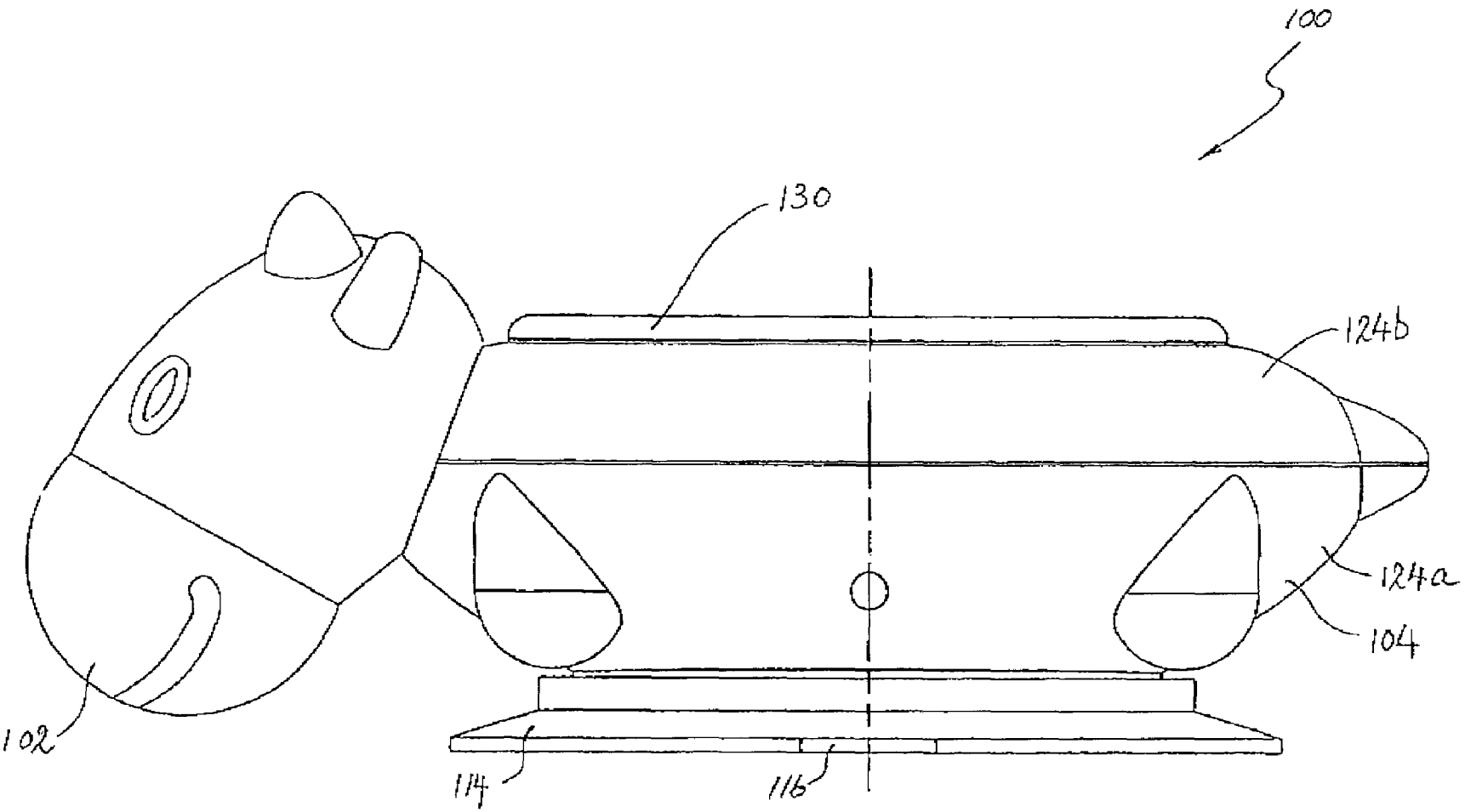
FIG. 1 is a side elevation view of a container of a set of eating utensils according to the present invention.
Figure 2:
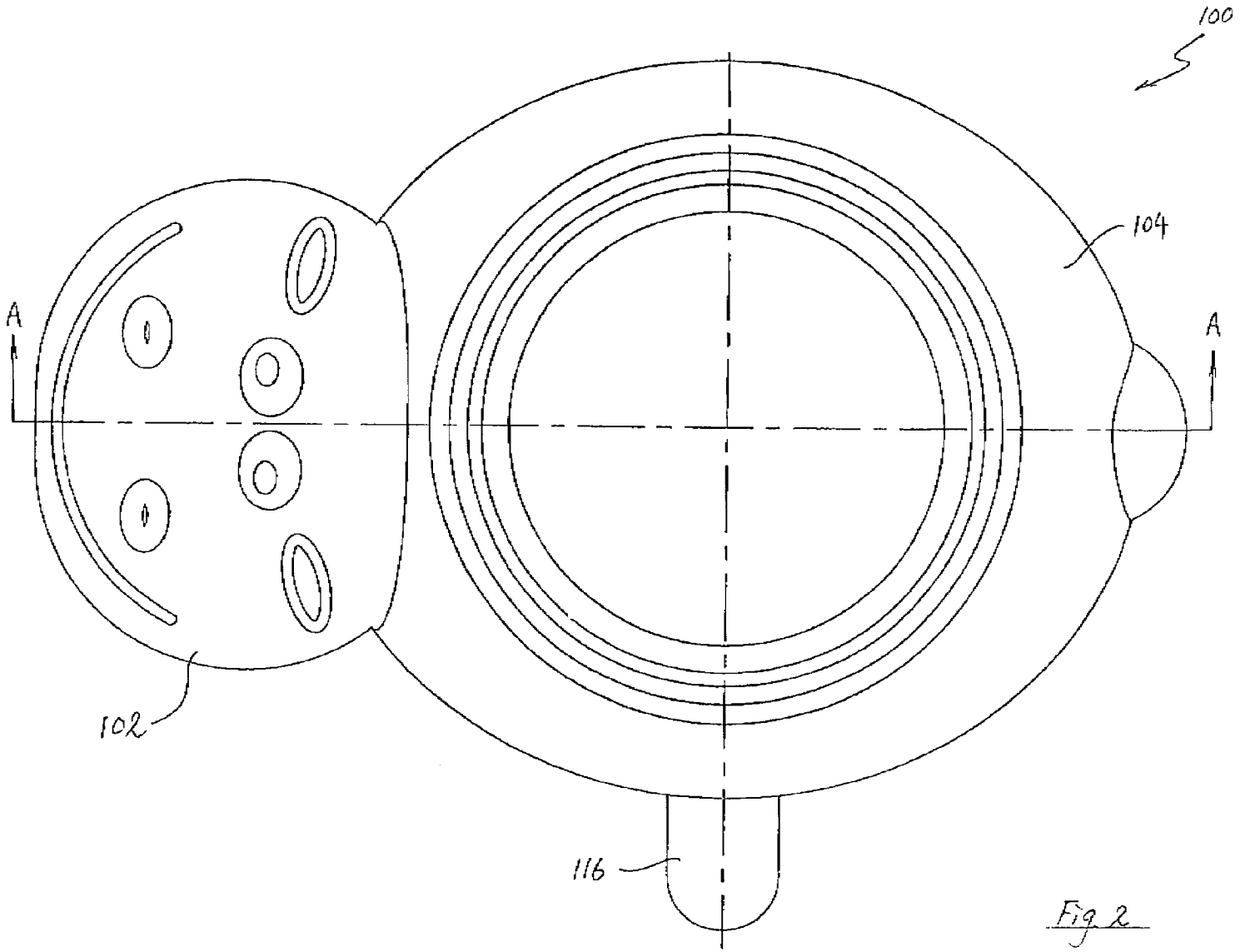
FIG. 2 is a top plan view of the container shown in FIG. 1.
Figure 3:
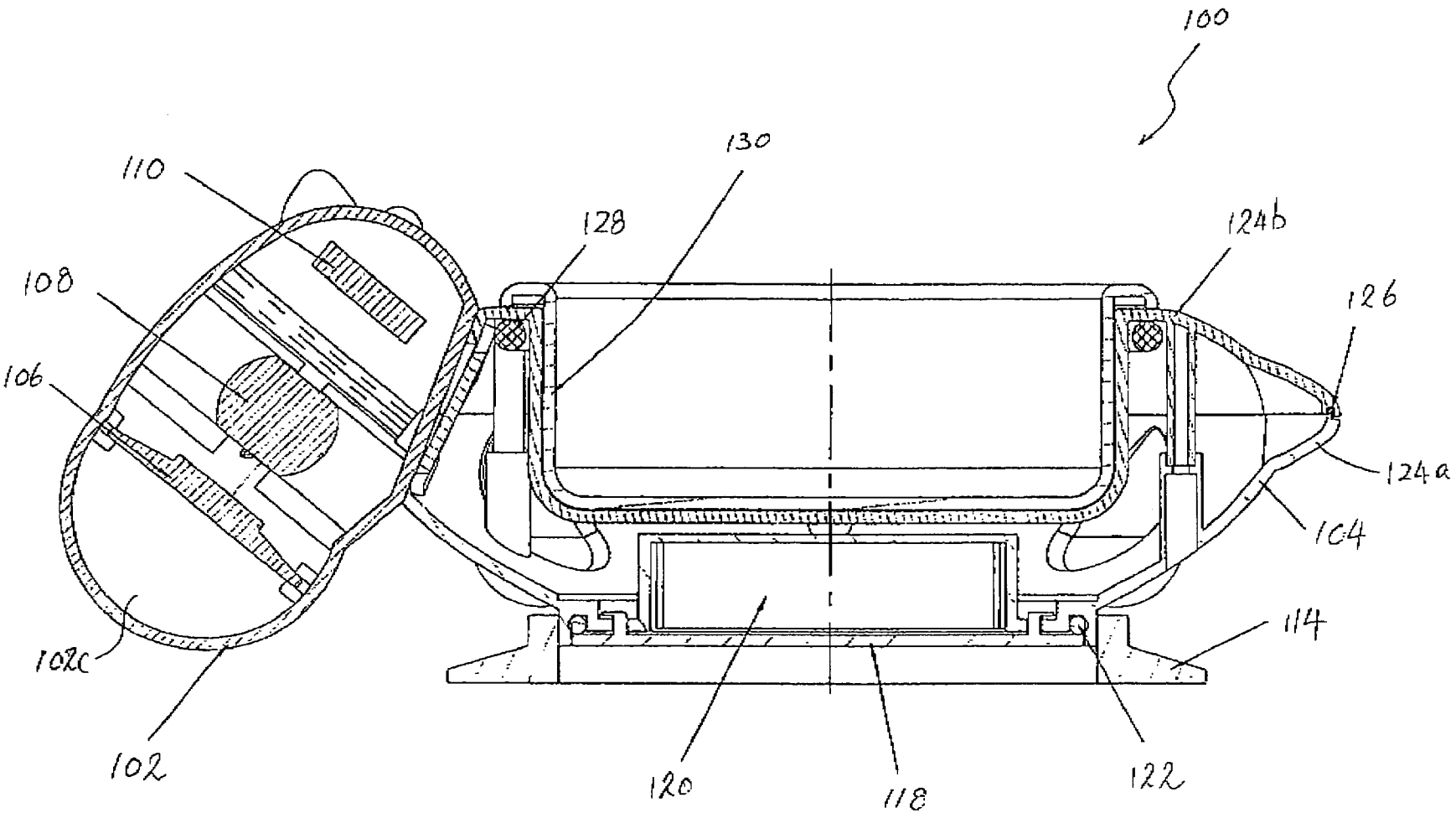
FIG. 3 is a side elevation sectional view taken along line A-A in FIG. 2.
Figure 4:
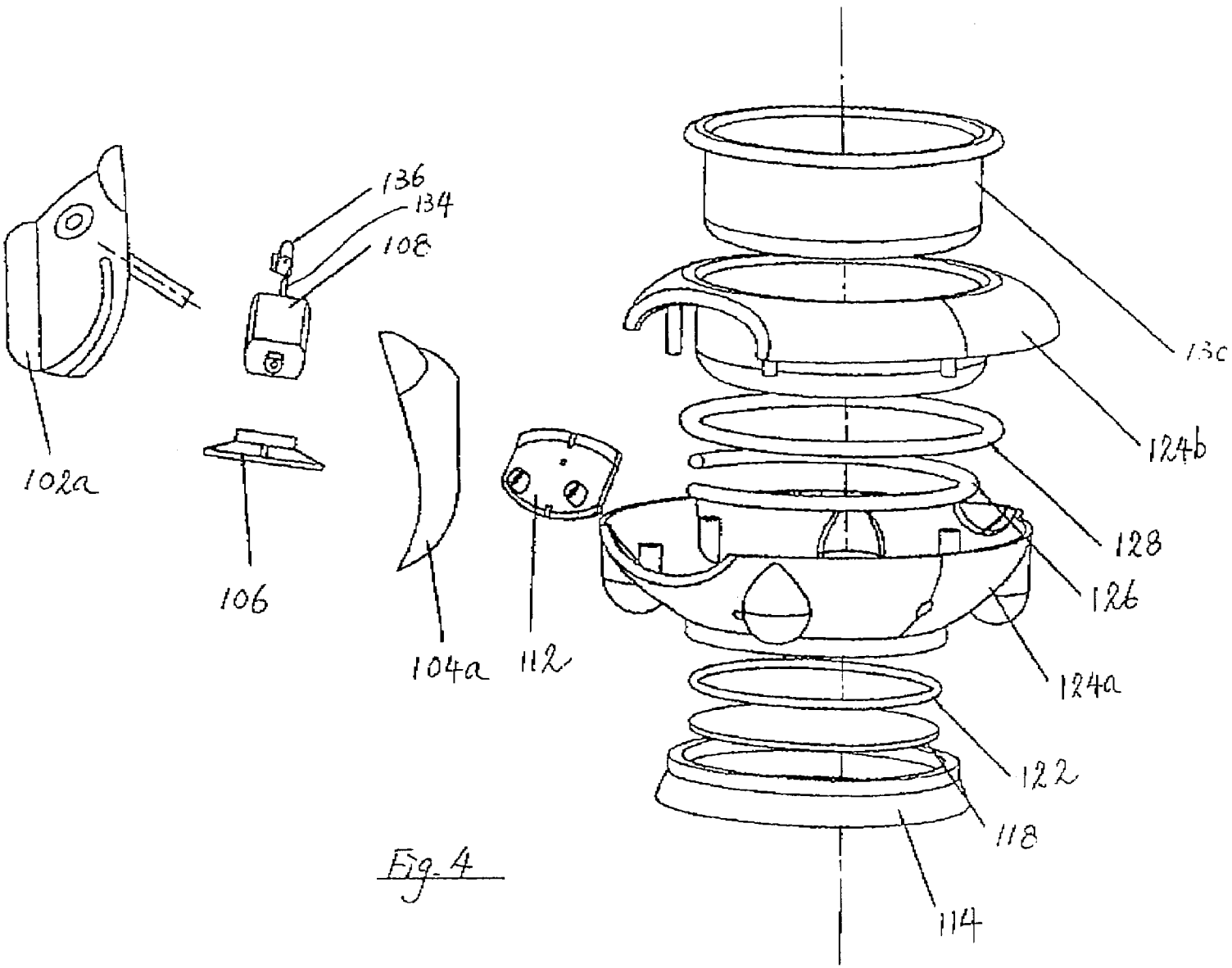
FIG. 4 is an exploded view of the container shown in FIG. 1.
Figures 5A, 5B, 5C, 5D:
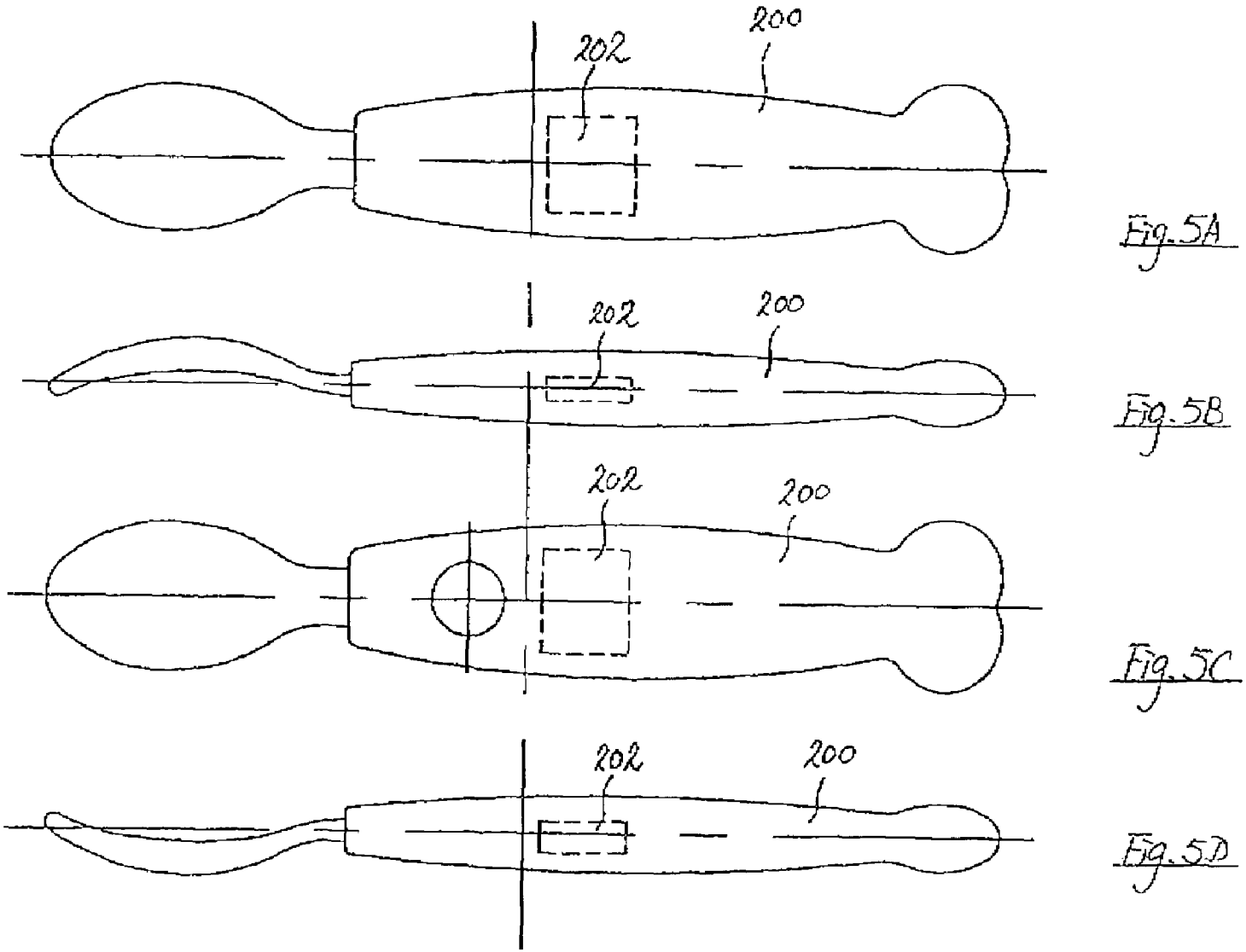
FIG. 5A is a bottom plan view of a spoon of a set of eating utensils according to the present invention.
FIG. 5B is a first side elevation view of the spoon shown in FIG. 5A.
FIG. 5C is a top plan view of the spoon shown in FIG. 5A.
FIG. 5D is a second side elevation view of the spoon shown in FIG. 5A.

As shown more clearly in FIG. 4, the head portion 102 comprises a front portion 102*a* and a rear portion 104*a* which collectively form a cavity 102*c* for housing a speaker 106, a motor 108, and a printed circuit board 110 (see FIG. 3) on which a circuitry including an integrated circuit (IC), to be discussed below, is provided. The head portion 102 is engaged with the body portion 104 via a bracket 112 in such a way that the head portion 102 may swivel relative to the body portion 104, mimicking a nodding movement. The front portion 102*a* and the rear portion 104*a* are made of acrylonitrile butadiene styrene (ABS). On an output spindle 134 of the motor 108 is mounted a load 136 for generating a torque when the motor 108 operates.

Turning to the body portion 104 of the container 100, such includes a sucking member 114 (e.g., a suction cup) made of a resilient plastic material for engaging the container 100 onto a surface, e.g. a table top, which avoids the container 100 being accidentally swept off of a table to which it is adhered via suction. A tongue 116 is provided for releasing the suction between the sucking member 114 and a surface, when desired. At the bottom of the body portion 104 is provided with a cover 118 for a compartment 120 for housing batteries (not shown) for operating the container 100, and an O-ring 122. The body portion 104 is mainly composed of a lower half 124*a* and an upper half 124*b*, with a split-ring sealing member 126 therebetween. An induction coil 128 is positioned close to the upper rim of the upper half 124*b*. A bowl 130 for containing food is seated in an upwardly open cavity of the upper half 124*b*. The bowl 130 may be easily removed from the rest of the container 100. While the lower half 124*a* and upper half 124*b* of the body portion 104 are made of acrylonitrile butadiene styrene (ABS), the bowl 130 is made of polypropylene (PP).

An embodiment of a piece of cutlery for a set of eating utensils of the present invention is spoon 200 shown in FIGS. 5A to 5D. Other types of cutlery, e.g. knives, forks or chopsticks, are also envisaged as being encompassed by the present invention. The spoon 200 is made of polypropylene (PP) over-molded with a thermoplastic elastomer, e.g. styrene-hydrogenated butadiene-styrene (SEBS). Inside the spoon 200 is embedded a magnet 202 that produces a magnetic field.

Figure 6:
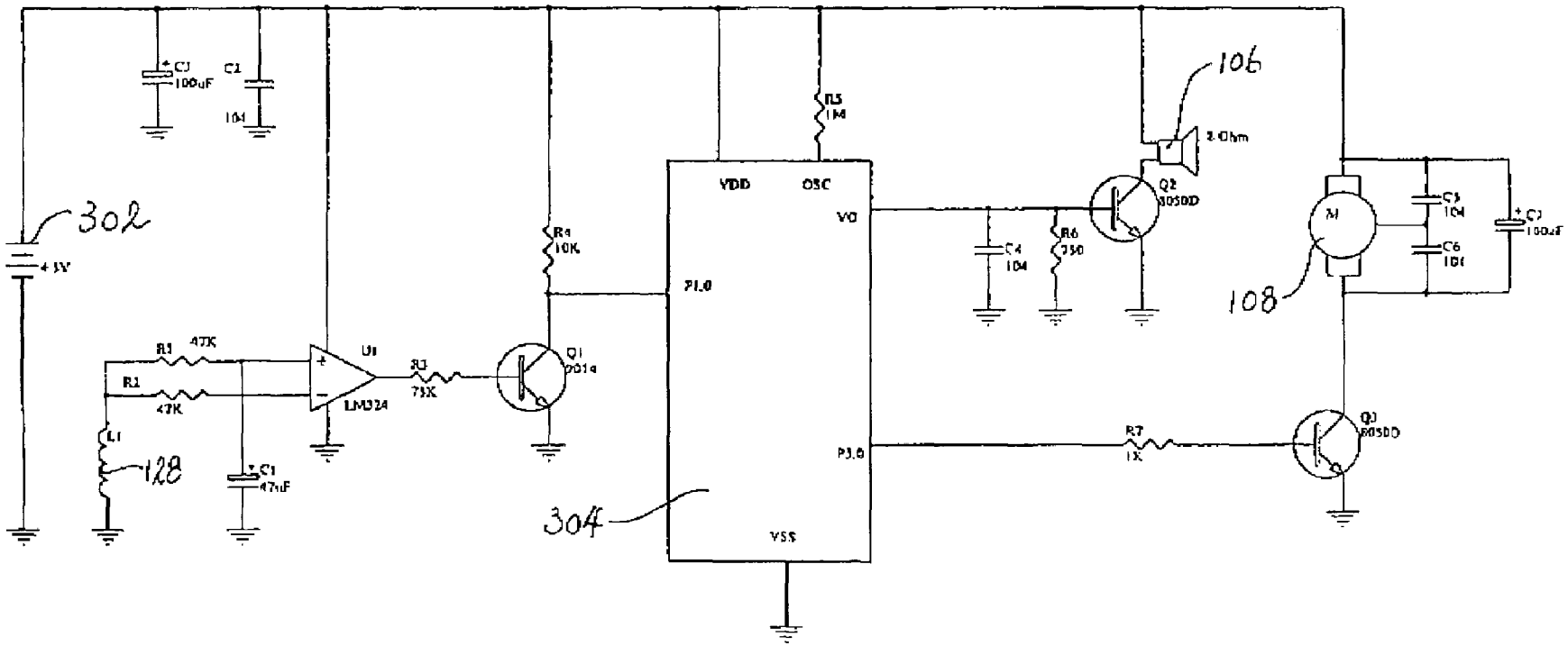
FIG. 6 is a circuit diagram for the electronic components of the container shown in FIG. 1.

FIG. 6 is a diagram showing the circuit arrangement in the container 100. The circuit is powered by one or more dry batteries 302 housed in the battery compartment 120 (see FIG. 3). As can be seen in FIG. 6, the induction coil 128 is electrically connected to the speaker 106 and the motor 108 via an integrated circuit (IC) 304. An IC which may be used in this connection is a tiny-controlled-based voice/dual tone melody/dual tone sound effect IC, with a One Time Programmable (OTP) ROM inside, traded by Elan Microelectronics Corp. of Elan, Taiwan, under their Series No. EM57P300.

Figure 7:
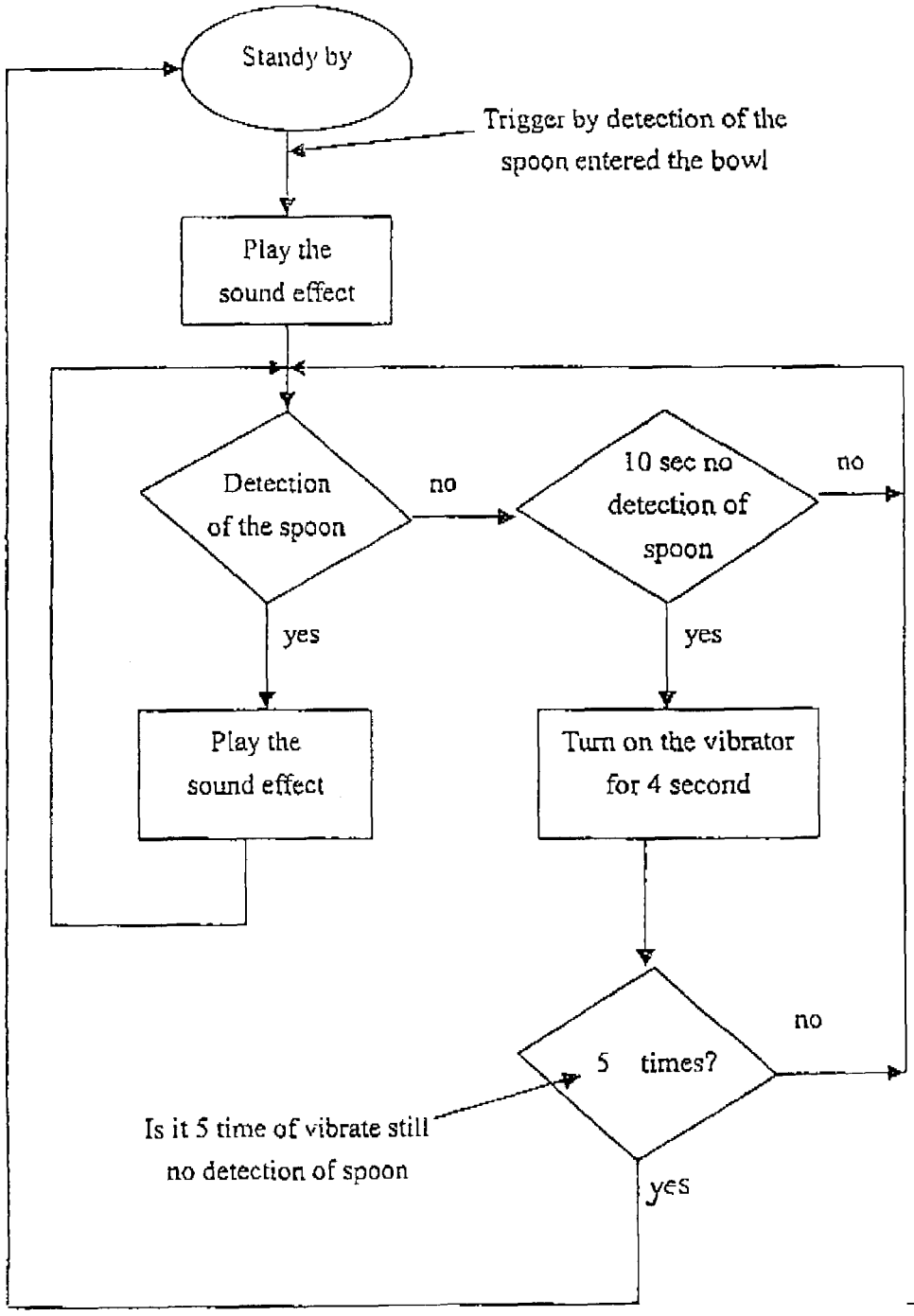
FIG. 7 is a flow chart of the operation of the set of eating utensils shown in FIGS. 1 to 6.

Turning now to FIG. 7, a flow chart is provided that shows the steps of operation of the set of eating utensils. First, the set of eating utensils are activated, e.g. by switching on the container 100 so that it is in a "STAND BY" mode. At this stage, an electric current passes through the coil 128 in the container 100, whereupon an electromagnetic field is generated around the coil 128. As the coil 128 is positioned close to the upper rim of the upper half 124*b* of the container 100, the electromagnetic field will extend into the cavity of the bowl 130. If the spoon 200 is moved relative to, and sufficiently close to, the bowl 130, e.g. if the spoon 200 is moved into the bowl 130, the magnetic field of the magnet 202 will cut, and thus interact with, the electromagnetic field of the coil 128. This will bring about a change in the magnetic flux of the coil 128, which will in turn draw and induce an electric current along the coil 128, which will either enhance or counteract the electric current in the induction coil 128. The variation in the magnitude and/or direction of the current will act as a signal transmitted to the IC 304, and cause the IC 304 to send out signals to the speaker 106 to output a sound that mimics that of an animal. For example, if the container 100 is designed to look like a cat, the sound to be outputted may be similar to meowing sound of a cat.

When the spoon 200 leaves the bowl 130, e.g. after collecting food from it, the electromagnetic field of the coil 128 will be cut again by the magnetic field of the magnet 202 of the passing spoon 200. A second sound may be outputted by the speaker 106. However, as a time delay of one second is built into the IC 304, the second sound effect may be cut if the movement of the spoon 200 into and out of the bowl 130 is too quick.

The IC 304 also includes a clock performing timing function, which will start to count down when no signal is received from the coil 128. If no signal is received from the coil 128 for a preset (predetermined) period of time of, e.g., ten seconds, the IC 304 will actuate the motor 108 to operate, whereupon the load 136 will rotate to generate a torque. This action will continue for about four seconds. The load 136 acts effectively as a vibrator, causing the head portion 102 of the container 100 to swivel relative to the body portion 104, thus mimicking the nodding movement of the animal. After this, the IC 304 will stop the motor 108 and again start counting down for up to ten seconds to see if any signal arrives from the coil 128. If not, rotation of the load 136, and thus vibration of the head portion 102, will again occur. If five such vibrations have already occurred, and still no signal is received from the coil 128 for another ten seconds (thus an absence of such signals for a total of one minute), the IC 304 will turn the container 100 back to the "STAND BY" mode, at which only a very small electric current runs through the circuit, thus saving battery power.

It can be seen that, by way of the present invention as discussed above, an animal sound will be outputted every time the spoon 200 enters into the bowl 130. This acts as a positive encouragement to the child to get food from within the bowl 130 by the spoon 200. In addition, when the child is somehow distracted, the nodding movement of the head 102 will help in catching his/her attention again.

It should be understood that the above only illustrates an example whereby the present invention may be carried out, and that various modifications and/or alterations may be made thereto without departing from the spirit of the invention. Thus, in an another embodiment, a container for a set of eating utensils of the present invention may be described as comprising a magnetic field sensor in a housing, said housing having at least one moveable portion that is moveable with respect to the remainder of the housing, said container further comprising a sound producing device, a moving mechanism for moving said at least one moveable portion, and circuitry for operating said sound producing device and said moving mechanism, wherein in response to said magnetic field sensor sensing a magnetic field said circuitry can cause at least one output selected from the group consisting of said sound producing device producing a sound, and said moving mechanism causing said moveable portion to move. The moving mechanism may cause only a vibration that can be sensed tactilely and/or may cause a more dramatic and visible motion. Preferably an eating utensil, such as a cutlery item, will comprise a magnet that produces a magnetic field sufficient to be sensed by the magnetic field sensor in the container when moved with respect thereto.

It should also be understood that certain features of the invention, which are, for the sake of clarity, described in the context of separate embodiments, may be provided in combination in a single embodiment. Conversely, various features of the invention which are, for brevity, described in the context of a single embodiment, may also be provided separately or in any appropriate sub-combinations. For example, only the mechanical motion producing output may be used in an embodiment, while the sound producing device is left out.

The invention claimed is:

1. A set of eating utensils comprising:

a first eating utensil and a container having an opening leading to a portion adapted to contain food, an upper rim surrounding the opening;

said first eating utensil comprises a magnetic member that produces a magnetic field;

an induction coil located adjacent to the opening surrounded by the upper rim such that an electromagnetic field is created at the opening leading to the food containing portion, the induction coil operatively connected to a first output device, movement into or out of the container by the first eating utensil producing a first output from the first output device upon the interaction of said magnetic field of said magnetic member with the electromagnetic field of said induction coil located adjacent said opening, as said magnetic member passing through said opening generates an electric current through said induction coil.

2. A set of eating utensils according to claim 1, wherein said container is in the general shape of an animal.

3. A set of eating utensils according to claim 1, wherein said first output device comprises a speaker.

4. A set of eating utensils according to claim 3, wherein said speaker is adapted to output sounds of an animal.

5. A set of eating utensils according to claim 1, wherein said induction coil is electrically connected to said first output device via an integrated circuit.

6. A set of eating utensils according to claim 1, further comprising a second output device electrically connected to said induction coil, said second output device producing a second output when said magnetic field produced by said magnetic member has not interacted with said electromagnetic field of said induction coil for a predetermined period of time, said induction coil electrically connected to said second output device via an integrated circuit.

7. A set of eating utensils according to claim 6, wherein said second output device comprises a motor, said second output being the activation of said motor.

8. A set of eating utensils according to claim 7, wherein an output spindle of said motor is mounted with a load.

9. A set of eating utensils according to claim 8, wherein said container comprises a head portion and a body portion, and said motor is positioned within said head portion.

10. A set of eating utensils according to claim 9, wherein said head portion is movable by said motor relative to said body portion, said second output being the movement of the head portion.

* * * * *